US009441902B2

(12) United States Patent
Noel

(10) Patent No.: US 9,441,902 B2
(45) Date of Patent: Sep. 13, 2016

(54) ARTICULATING AIMING SUPPORT

(71) Applicant: Brian K. Noel, Belleville, MI (US)

(72) Inventor: Brian K. Noel, Belleville, MI (US)

( * ) Notice: Subject to any disclaimer, the term of this patent is extended or adjusted under 35 U.S.C. 154(b) by 0 days.

(21) Appl. No.: 14/558,960

(22) Filed: Dec. 3, 2014

(65) Prior Publication Data

US 2015/0153127 A1 Jun. 4, 2015

Related U.S. Application Data

(60) Provisional application No. 61/911,605, filed on Dec. 4, 2013.

(51) Int. Cl.

| | |
|---|---|
| ***E04G 3/00*** | (2006.01) |
| ***F41A 23/18*** | (2006.01) |
| ***F41A 23/56*** | (2006.01) |
| ***F41A 23/16*** | (2006.01) |

(52) U.S. Cl.

CPC ..... *F41A 23/18* (2013.01); *E04G 3/00* (2013.01); *F41A 23/16* (2013.01); *F41A 23/56* (2013.01)

(58) Field of Classification Search

CPC ..... E04G 3/00; F41A 23/56; F41A 23/18; F41A 23/16

USPC ..... 182/187

See application file for complete search history.

(56) References Cited

U.S. PATENT DOCUMENTS

| | | | | |
|---|---|---|---|---|
| 6,637,708 | B1 * | 10/2003 | Peterson | 248/285.1 |
| 7,658,140 | B2 * | 2/2010 | Lombardi | 89/37.04 |
| 2013/0256059 | A1 * | 10/2013 | Hughes | 182/129 |

FOREIGN PATENT DOCUMENTS

WO WO 80/00794 * 5/1980

* cited by examiner

*Primary Examiner* — Stephen M Johnson
(74) *Attorney, Agent, or Firm* — Gerald R. Black, Esq.

(57) ABSTRACT

An articulating aiming support for use in an elevated stand enables a marksman to stabilize shots for increased accuracy while reducing fatigue from holding a rifle in a free position. The rest may also be used for photographic uses by using a camera mount in place of a shooting stick. The firearms rest comprises of two sections of tubing which slide into one another with a pivot mounted to one end, which is used to mount the rest onto a tree stand, while the tube which extends has a plurality of supports on the other end. These supports have mounting pads located on the ends, which are adjustable for height, which the marksman uses mount the apparatus to base of a tree stand, steadying their shots. The firearms rest collapses down for ease of transport and storage and may be made from any, strong lightweight material.

20 Claims, 4 Drawing Sheets

ARTICULATING AIMING SUPPORT

This application is related to and claims priority to U.S. Provisional Application No. 61/911,605, by Brian K. Noel, entitled "Articulating Aiming Support," filed on Dec. 4, 2013.

FIELD OF USE

The present invention relates to a articulating aiming support for use with a firearm or photographic equipment.

BACKGROUND OF THE INVENTION

Prior approaches to articulating aiming supports for firearms and photographic equipment involve a rest which is placed upon a flat surface, such as a shooting bench, or on the ground and then leveled with adjustable feet so as to insure a flat and stable shooting platform for the marksman.

Tree stand mounted rests work via the same principle, while being attached to the tree stand in some way, and include a pivot enabling the marksman to move within a certain range while maintaining a steady shooting position.

Some of the prior art includes:

U.S. Pat. No. 6,637,708 (Peterson) discloses an aiming support apparatus dependable from a central portion of a shooting platform is provided. The apparatus includes an arm having a base and an extension selectively extendible from a free end of the arm base. The arm extension includes a socket adapted to receive a shooting staff. The arm base is suspended from a bracket assembly for pivot motion about a pivot axis. The bracket assembly is affixable to the shooting platform so as to substantially underlay a shooter positioned thereon, the socket being swingingly positionable beyond a perimeter of the shooting platform in response to a marksman's torso motions in furtherance of pursuit of a scoped target.

U.S. Pat. No. 8,393,106 (Cauley; et al.) discloses shooting rests having elevation adjustment assemblies are disclosed herein. One embodiment of the disclosure, for example, is directed to a shooting rest for supporting a firearm having a buttstock spaced apart from a forestock. The shooting rest includes a first base portion carrying a first support for supporting the buttstock and a second base portion coupled to the first base portion and carrying a second support for supporting the forestock.

U.S. Pat. No. 8,356,442 (Potterfield; et. al.) discloses adjustable shooting rests and shooting rest assemblies are disclosed herein. In one embodiment, a shooting rest includes a rest assembly for supporting a forestock of a firearm. The rest assembly includes a base member and first and second upright members extending from the base member. A position of each of the first and second upright members is independently adjustable with reference to the base member. The shooting rest also includes a support assembly coupled to the rest assembly to move the rest assembly in a first direction and in a second direction.

U.S. Pat. No. 5,979,099 (Kervin) discloses a truck mountable shooting rest that includes an attachment structure that is attachable to the bed wall of a pickup truck and a rifle support structure that is adjustably positionable by the user with respect to the attachment structure. The attachment structure includes a deformable friction insert sized to deformably friction fit into a bedwall hole of a pickup truck bedwall, a stop block formed at an end of the friction insert, and a support rod passageway formed through the friction insert and the stop block.

What is needed is a portable, lightweight, easy to use articulated aiming support which is attachable to a tree stand or other elevated platform, giving the user the ability to acquire targets from a variety of locations, while enabling the user to maintain steady aim, increasing the likelihood of hitting the desired target or of capturing high quality photographic images.

SUMMARY OF THE INVENTION

The primary object of the articulating aiming support of the present invention is to give the marksman or a photographer a steady, portable, and easily adjustable platform from which to aim from an elevated position.

The articulating aiming support of the present invention addresses these needs and objectives.

The articulating aiming support stabilizes a firearm relative to a tree stand. The articulating aiming support comprises a pivot, a plurality of support arms, a main support tube, an extension tube, an extension tube lock, and a shooting stick holder. The pivot is positionable underneath a tree stand, the tree stand is mountable in a tree, and the tree stand is capable of supporting the weight of a marksman. The plurality of support arms are attachable to the pivot, each support arm including a support pad for mounting the tree stand. The main support tube is swingably attachable to the pivot. The extension tube is slideably engageable relative to the main support tube. The extension tube lock secures the position of the extension tube relative to the main support tube. The shooting stick holder securely retains a shooting stick, the shooting stick stabilizes a firearm, the shooting stick holder is secured to the extension tube. The shooting stick holder, in use, enables the marksman to track a target as the target moves below and about the tree stand. The articulating aiming support collapses down for ease of transport and storage and may be made from any, strong lightweight material.

In the first preferred embodiment of the present invention, the shooting rest system includes two sections of tubing, which collapse into one another, which have a pivot attached for mounting to a tree stand. Attached to the piece of tubing which extends from the tube attached to the pivot is a rest with three arms which swing outwardly and lock into place. Attached to said arms are adjustable pads which enable the marksman to attach the apparatus to the bottom of a tree stand, thus stabilizing the rifle and enabling for a more accurate and stable shot. The rest will attach to the underside of a tree stand and enable essentially full angular rotation (about 350 degrees) providing the marksman with the ability to shoot from any essentially angle. The articulating aiming support of the present invention is collapsible enabling for a small form factor and is easily stowed into a backpack or carried by hand.

The articulating aiming support of the present invention can also be used with photographic equipment to take high quality photographic images from an elevated stand.

For a complete understanding of the articulating aiming support apparatus of the present invention, reference is made to the following summary of the invention detailed description and accompanying drawings in which the presently preferred embodiments of the invention are shown by way of example. As the invention may be embodied in many forms without departing from spirit of essential characteristics thereof, it is expressly understood that the drawings are for purposes of illustration and description only, and are not intended as a definition of the limits of the invention.

DETAILED DESCRIPTION OF THE PREFERRED EMBODIMENTS

Figure 1:
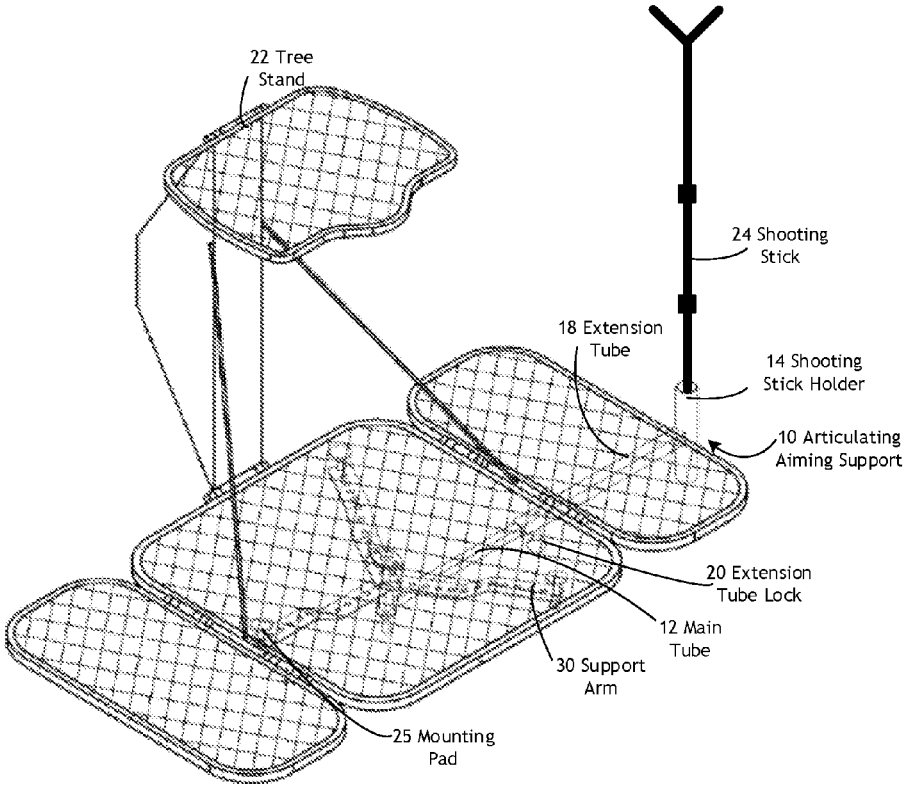
FIG. 1 depicts an environmental view of the preferred embodiment of the articulating aiming support of the present invention with a shooting stick affixed to an elevated stand or tree stand.
Figure 2:
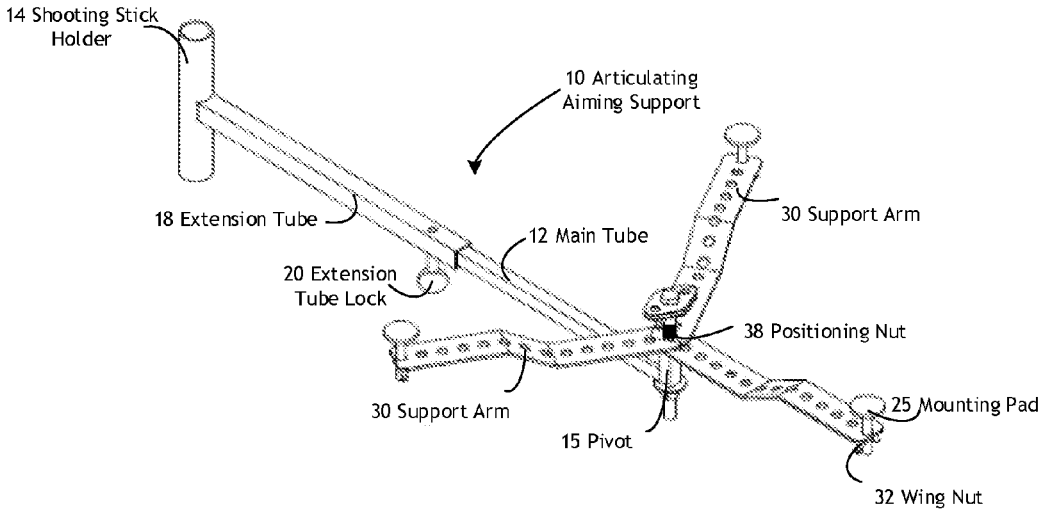
FIG. 2 depicts a perspective view of a first preferred embodiment of the articulating aiming support shown in FIG. 1.

Referring now to the drawings, FIG. 1 depicts a perspective view of the preferred embodiment of the articulated aiming support [10] of the present invention with a tree stand [22] with a shooting stick [24] inserted into a stabilization mount [35] and FIG. 2 depicts a perspective view of the first preferred embodiment of the articulated aiming support [10] shown in FIG. 1.

The articulated aiming support [10] of the present invention comprises a stabilization mount which is attached to the main tube [12] with the extension tube [18] shown in the extended position. The extension tube [18] is of a smaller diameter than the main tube [12] enabling the extension tube [18] to slide into the main tube [12]. Attached to the main tube is a tube lock [20] which locks the extension tube [18] preventing it from sliding back into the main tube [12] during use. The tube lock [20] could also be a ball detent type lock, which will automatically lock into a recess in the extension tube [18] when it is extended. To retract the extension tube [18] back into the main tube [12] the user will need to depress the ball, and while holding it down, slide the tube until the ball is no longer in the recess in the extension tube [18]. Once the extension tube is slid completely back into the main tube [12] the ball detent will lock into a recess at the end of the extension tube [18], preventing the extension tube [18] from extending during transport, or in the case a shorter rest is needed. Along the base of the extension tube [18] are equally spaced recesses, which will enable the length of the rest to be adjusted depending on user preference. The extension tube [12] is attached to the shooting stick holder [14], enabling free rotational movement in which it is estimated to be about a range of 350° of the shooting stick relative to the tree stand.

Attached to the end of the extension tube [18] are three support arms [30], which are perforated for weight reduction and are mounted in such a manner so as to enable them to be folded beneath one another so as to enable for ease of storage and transport. Conversely, the mounting point of the support arms [30] enables for the support arms [30] to be detached for replacement, or for transport. At the ends of the support arms [30] are mounting pads [25] which enable the user to attach to the rest to the bottom of a tree stand. The mounting pads [25] are threaded on the bottom and are attached via a wing nut [32]. The mounting pads [25] can be mounted to the support arm [30] in any of the weight reduction holes which are drilled into the support arm [30]. The mounting pads [25] are adjustable for height and each can be set differently if the marksman desires so as to enable for different shooting heights, to take into account obstructions in the marksman's line of sight.

The shooting stick holder [14] enables the marksman to rotate the shooting stick [24] about 350° degrees relative to the tree stand [22], enabling for a panoramic shooting view. The pivot [15] mounts to the underside of a tree stand and moves freely, thereby enabling the marksman to move the articulating aiming support [10] out of the way when not needed and to quickly use it when necessary.

The apparatus comprises a stabilization mount [35], which is attached to the main tube [12] with the extension tube [18] shown in the extended position. The extension tube [18] is of a smaller diameter than the main tube [12] enabling the extension tube [18] to slide into the main tube [12]. Attached to the main tube is a tube lock [20] which locks the extension tube [18] preventing it from sliding relative to the main tube [12] during use. The tube lock [20] can also be a ball detent type lock, which will automatically lock into a recess in the extension tube [18] when it is extended. To retract the extension tube [18] back into the main tube [12] the user will need to depress the ball, and while holding it down, slide the tube until the ball is no longer in the recess in the extension tube [18]. Once the extension tube is slid completely back into the main tube [12] the ball detent will lock into a recess at the end of the extension tube [18], preventing the extension tube [18] from extending during transport, or in the case a shorter rest is needed. Along the base of the extension tube [18] are equally spaced recesses, which will enable the length of the rest to be adjusted depending on user preference. The extension tube [12] is attached to the pivot [15], enabling free movement in a 350 degree range.

A stabilization apparatus for a rifle, such as a shooting stick [24], or camera mount [38], is inserted into the stabilization mount [35], enabling the user to stabilize their rifle, or camera for accurate and stable shots. For a rifle, the accuracy and control gained from resting the firearm onto a stable platform is immeasurable, while for a photographer, the stability gain guarantees a picture which is free from blur. Conversely, a video camera mount can be substituted for videographers who are making nature films, or if they are using a stand mounted to a pole.

Attached to the end of the extension tube [18] are three support arms [30], which are perforated for weight reduction and are mounted in such a manner so as to enable them to be folded beneath one another so as to enable for ease of storage and transport. Conversely, the mounting point of the support arms [30] enables for the support arms [30] to be detached for replacement, or for transport. At the ends of the support arms [30] are mounting pads [25] which enable the user to attach to the rest to the bottom of a tree stand. The mounting pads [25] are threaded on the bottom and are attached via a wing nut [32]. The mounting pads [25] can be mounted to the support arm [30] in any of the weight reduction holes drilled into the support arm [30]. The mounting pads [25] are adjustable for height and each can be set to a different if the user desires so as to enable for different shooting heights, to take into account obstructions in the marksman's line of sight.

The pivot [15] enables the marksman to rotate the firearms mount [10] 350 degrees, enabling for a panoramic shooting view. The pivot [15] mounts to the underside of a tree stand and moves freely, thus enabling the marksman to move the firearms rest [10] out of the way when not needed and to quickly utilized it when necessary.

Figure 3:
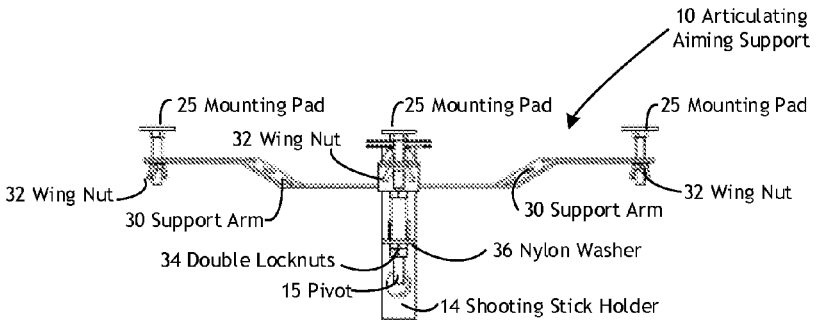
FIGS. 3, 4, and 5 depict the front view, the side view, and the top view, respectively, of the articulating aiming support of FIG. 2.
Figure 4:
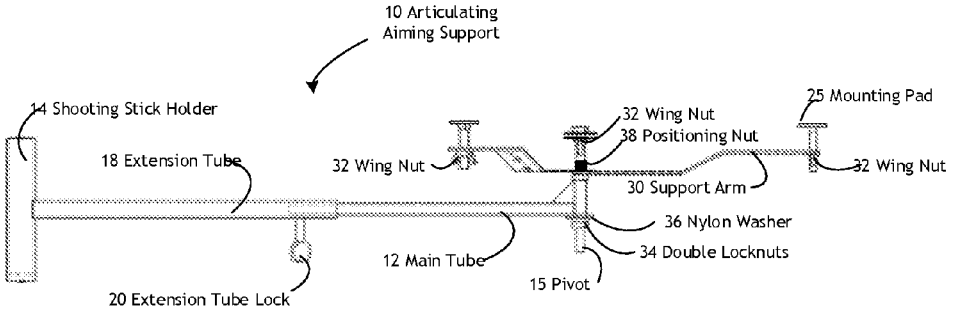
Figure 5:
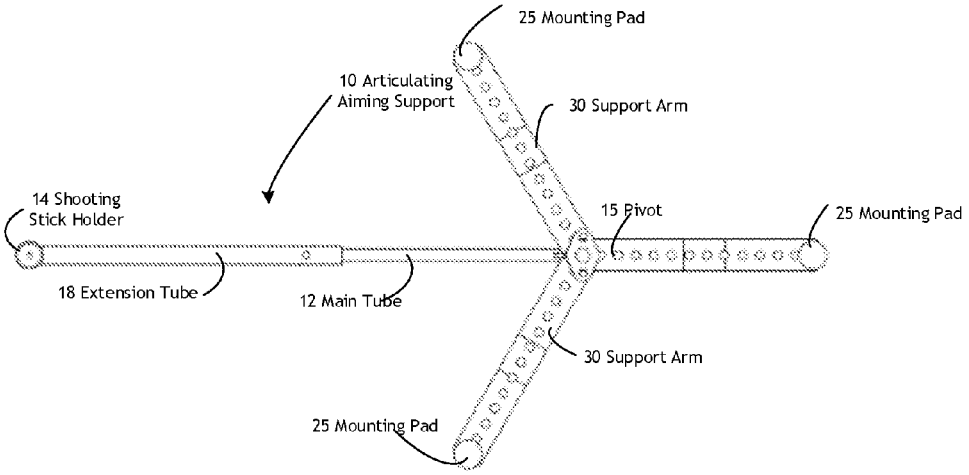

FIGS. 3, 4, and 5 depict the front view, the side view, and the top view, respectively, of the articulating aiming support [10] of FIG. 2.

In FIG. 5, it is clearly visible how the extension tube [18] slides into the main tube [12] with the tube lock [20] securely engaging the extension tube [18] preventing it from sliding completely out of the main tube [12] and providing a stable shooting platform.

The articulated aiming support [10] main tube [12] can be made from aluminum, steel, polycarbonate, or any other material utilizing square, round, oval, hexagonal tubing etc.

When the articulated aiming support [10] is completely collapsed and the support arms [30] folded inwardly over one another, it can be easily carried, stowed in a back pack, put underneath, or behind a vehicle seat.

Figure 6:
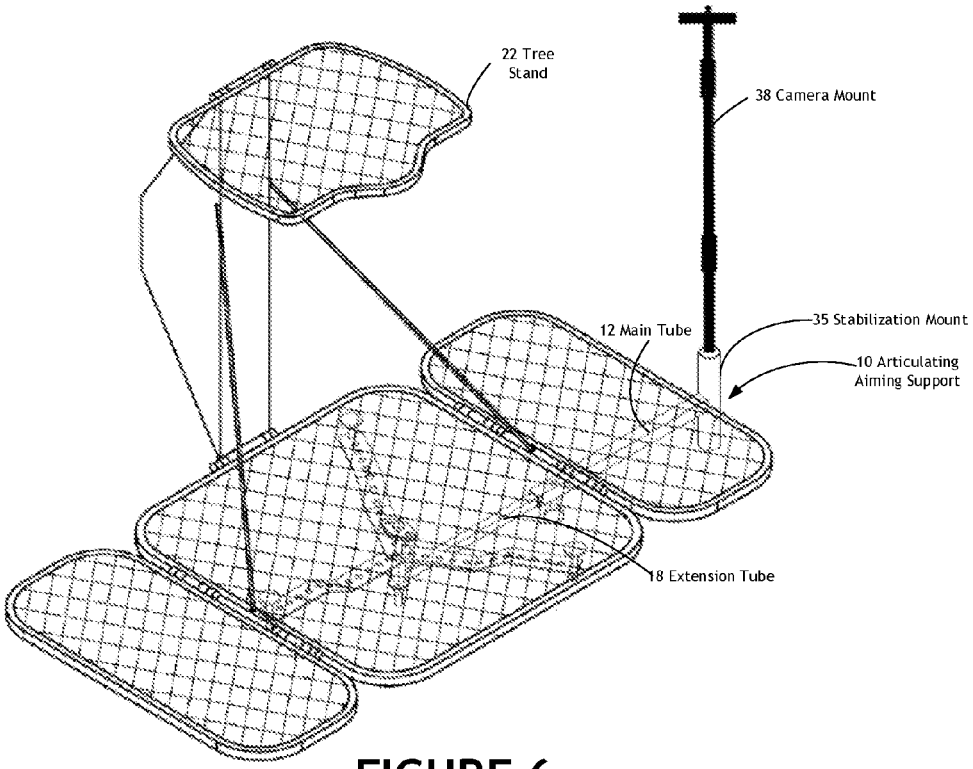
FIG. 6 depicts an environmental view of a second preferred embodiment of the articulating aiming support of the present invention with a camera mount affixed to an elevated stand.

FIG. 6 depicts an environmental view of a second preferred embodiment of the articulating aiming support of the present invention with a camera mount [39] affixed to an elevated stand. This embodiment is for photographers who want to photograph images from above. In this embodiment, a monopod mount can be inserted into the stabilization mount [35] enabling a stable platform from which a photographer can take pictures.

A stabilization apparatus for a firearm is inserted into the shooting stick holder [14], enabling the user to stabilize their firearm, or camera for accurate and stable shots. For a firearm, the accuracy and control gained from resting the firearm onto a stable platform is immeasurable, while for a photographer, the stability gain, guarantees a picture which is free from blur. Conversely, a video camera mount is substituted for videographers who are making nature films, or if they are using a stand mounted to a pole.

Throughout this application, various Patents and Applications are referenced by number and inventor. The disclosures of these documents in their entireties are hereby incorporated by reference into this specification in order to more fully describe the state of the art to which this invention pertains.

It is evident that many alternatives, modifications, and variations of the articulated aiming support [10] of the present invention will be apparent to those skilled in the art in light of the disclosure herein. It is intended that the metes and bounds of the present invention be determined by the appended claims rather than by the language of the above specification, and that all such alternatives, modifications, and variations which form a conjointly cooperative equivalent are intended to be included within the spirit and scope of these claims.

PARTS LIST

10. Articulating Aiming Support
12. Main Tube
14. Shooting Stick Holder
15. Pivoting Member
18. Extension Tube
20. Extension Tube Lock
22. Tree Stand
24. Shooting Stick
25. Firearm Support Pad
30. Support Arm
32. Wing Nut
35. Rifle Stabilization Mount
34. Double Locknuts
36. Nylon Washer
38. Positioning Nut
39. Camera Mount

I claim:

1. An articulating aiming support for stabilizing a firearm relative to a tree stand, said articulating aiming support comprising;

a. a pivot member positionable underneath said tree stand, said tree stand being mounted in a tree and being capable of supporting a weight of a marksman;

b. a multiplicity of support arms being pivotally attachable to said pivot member, each of said multiplicity of support arms extending out from said pivot member, each of said multiplicity of support arms including a support pad for mounting said tree stand;

c. a main tube being swingably attachable to said pivot member having an extension tube being slideably engageable relative to said main tube; and d. an extension tube lock securing a position of said extension tube relative to said main tube; and e. a shooting stick holder for securely retaining a shooting stick, said shooting stick stabilizing said firearm, said shooting stick holder being secured to said extension tube;

whereby, said shooting stick holder, in use, enables said marksman to track a target as said target moves below and about said tree stand.

2. The articulating aiming support of claim 1, wherein said extension tube lock prevents said extension tube from sliding completely off of said main tube.

3. The articulating aiming support of claim 1, wherein said extension tube is slideably engageable relative to said main tube.

4. The articulating aiming support of claim 1, wherein said multiplicity of support arms are removable from said articulating aiming support.

5. The articulating aiming support of claim 1, further comprising additional support arms to be added as necessary to stabilize said articulating aiming support.

6. The articulating aiming support of claim 1, wherein said articulating aiming support is collapsible for ease of transport and storage.

7. A shooting mount apparatus for stabilizing a firearm or camera relative to an elevated stand, said shooting mount apparatus comprising;

a. a pivot member positionable underneath said elevated stand, said elevated stand being mountable in an elevated place, said elevated stand being capable of supporting a weight of a person;

b. a multiplicity of support arms being pivotally attachable to said pivot member, at least one of said multiplicity of support arms extending out from said pivot member, at least one of said multiplicity of support arm including a support pad for mounting said tree stand;

c. a main tube being swingably attachable to said pivot member, said main tube being slideably engageable relative to an extension tube; and d. an extension tube lock securing a position of said extension tube relative to said main tube; and e. a holder for securely retaining a mounting apparatus for said firearm or camera, said mounting apparatus stabilizing said firearm or camera, said firearm or camera mounting apparatus holder being secured to said extension tube;

whereby, said apparatus, in use, enables said person to track a target as said target moves below and about said elevated stand.

8. The apparatus of claim 7, wherein said pivot member is mountable to a base of said elevation stand, enabling for a plurality of shooting positions.

9. The shooting mount apparatus of claim 7, wherein said extension tube lock prevents said extension tube from sliding completely off of said main tube.

10. The shooting mount apparatus of claim 7, wherein said extension tube is slideably engageable relative to said main tube.

11. The shooting mount apparatus of claim 7, wherein said support arms are removable from said articulating aiming support.

12. The shooting mount apparatus of claim 7, further comprising additional support arms to be added as necessary to stabilize said articulating aiming support.

13. The shooting mount apparatus of claim 7, wherein said pivot member is mountable to a base of said elevation stand, enabling for a plurality of shooting positions.

14. The shooting mount apparatus of claim 7, wherein said shooting mount apparatus is collapsible for ease of transport and storage.

15. An articulating aiming support for stabilizing a camera relative to an elevated stand, said articulating aiming support comprising;

a. a pivot member positionable underneath said elevated stand, said elevated stand being mountable in an elevated place, said elevated stand being capable of supporting the weight of a person;

b. a multiplicity of support arms being pivotally attachable to said pivot member, each of said multiplicity of support arms extending out from said pivot member, each of said multiplicity of support arms including a support pad for mounting said tree stand;

c. a main tube being swingably attachable to said pivot member having an extension tube being slideably engageable relative to said main tube; and d. an extension tube lock securing a position of said extension tube relative to said main tube; and e. a shooting stick holder for securely retaining a shooting stick, said shooting stick stabilizing said camera, said shooting stick holder being secured to said extension tube;

whereby, said articulating aiming support, in use, enables said person to track a target as said target moves below and about said elevated stand.

16. The articulating aiming support of claim 15, wherein said extension tube lock prevents said extension tube from sliding completely off of said main tube.

17. The articulating aiming support of claim 15, wherein said extension tube is slideably engageable relative to said main tube.

18. The articulating aiming support of claim 15, wherein said multiplicity of support arms are removable from said articulating aiming support.

19. The articulating aiming support of claim 15, further comprising additional support arms to be added as necessary to stabilize said shooting mount apparatus.

20. The articulating aiming support of claim 15, wherein said articulating aiming support is collapsible for ease of transport and storage.

* * * * *